US007722512B2

(12) United States Patent
Liang et al.

(10) Patent No.: US 7,722,512 B2
(45) Date of Patent: May 25, 2010

(54) PRONE EXERCISER

(76) Inventors: Fa-Kuang Liang, B1, No.20, Shia-Men Street, Taipei 10077 (TW); Po-Yeh Liang, B1, No.20, Shia-Men Street, Taipei 10077 (TW)

( * ) Notice: Subject to any disclaimer, the term of this patent is extended or adjusted under 35 U.S.C. 154(b) by 352 days.

(21) Appl. No.: 11/987,002

(22) Filed: Nov. 26, 2007

(65) Prior Publication Data

US 2010/0048367 A1 Feb. 25, 2010

(51) Int. Cl.
*A63B 21/04* (2006.01)
*A63B 26/00* (2006.01)

(52) U.S. Cl. ..... 482/130; 482/142

(58) Field of Classification Search ..... 482/128–131, 482/72–73, 142, 140, 904, 123, 51
See application file for complete search history.

(56) References Cited

U.S. PATENT DOCUMENTS 4,111,417 A * 9/1978 Gardner ..... 482/128
4,911,438 A * 3/1990 Van Straaten ..... 482/96
5,295,935 A * 3/1994 Wang ..... 482/130
5,518,483 A * 5/1996 Oswald ..... 482/131
6,001,051 A * 12/1999 Chuan-Pin ..... 482/131
6,932,749 B2 * 8/2005 Barnes et al. ..... 482/142

* cited by examiner

*Primary Examiner*—Fenn C Mathew
(74) *Attorney, Agent, or Firm*—Muncy, Geissler, Olds & Lowe, PLLC

(57) ABSTRACT

A prone exerciser includes a slide unit disposed with at least a rail, a buffering and locating member, a handle, and a pedal. The buffering and locating member is fixed on front end of the rail for providing buffering and locating effects to the handle. The handle is arranged on the rail, between the buffering and locating member and the pedal, and is sliding forwards and backwards. The pedal is disposed on rear end of the rail and is sliding forwards and backwards along the rail. By adjusting position of the buffering and locating member on front end of the rail, the distance of the handle and the pedal sliding on the rail is determined. Users are prone and operate the handle as well as pedal for sliding forwards and backwards on the rail so as to stretch and contract upper part or lower part of the body respectively or simultaneously. Moreover, the exerciser further includes an elastic rope with one end set on front end of the slide unit while the other end thereof is inserted through rear end of the slide unit and then set on the handle or the pedal so as to increase resistance of the handle or the pedal while sliding forwards and backwards on the rail. Thus users can stretch or contract upper part or lower part of bodies with different strength depending on their needs.

8 Claims, 9 Drawing Sheets

PRONE EXERCISER

BACKGROUND OF THE INVENTION

The present invention relates to a prone exerciser, especially to an exerciser with a handle, a pedal slides forwards and backwards on a rail respectively or simultaneously by operation of users so as to make upper part or lower part of users achieve stretching or contracting effects.

Refer to Taiwanese patent application publication No. 255203, No. 323524, U.S. Pat. No. 5,447,483, U.S. Pat. No. 6,306,065 B1, and China patent application No. 00217585.1 while operating the devices, the handle slides forwards freely without any limits so that the device takes larger space. Moreover, the movement of the handle is not specific for upper part or lower part of the body. Thus users can't stretch or contract only specific area of the body.

SUMMARY OF THE INVENTION

Therefore it is a primary object of the present invention to provide a prone exerciser composed of a slide unit disposed with a rail, a buffering and locating member, a handle, and a pedal. The buffering and locating member is arranged on front end of the rail and position of the member on the rail is adjustable so as to restrict sliding distance of the handle and the paddle on the rail. The handle and the paddle slides on the rail so that users can operate the handle by hands to move forwards and users' feet operate the pedal also move forwards to contact and connect with the handle. Then the combinations of the handle and the pedal move backwards along the rail and turn back to original status so as to achieve a cycle of movement for stretching and contracting upper part and lower part of users bodies.

It is another object of the present invention to provide a prone exerciser that further includes an elastic rope with one end set on front end of the slide unit while the other end thereof is inserted through rear end of the slide unit and then set on the handle or the pedal so as to increase resistance of the handle or the pedal while sliding forwards and backwards on the rail. Thus users can stretch or contract upper part or lower part of bodies with different strength depending on their needs.

DETAILED DESCRIPTION OF THE PREFERRED EMBODIMENT

Figure 1:
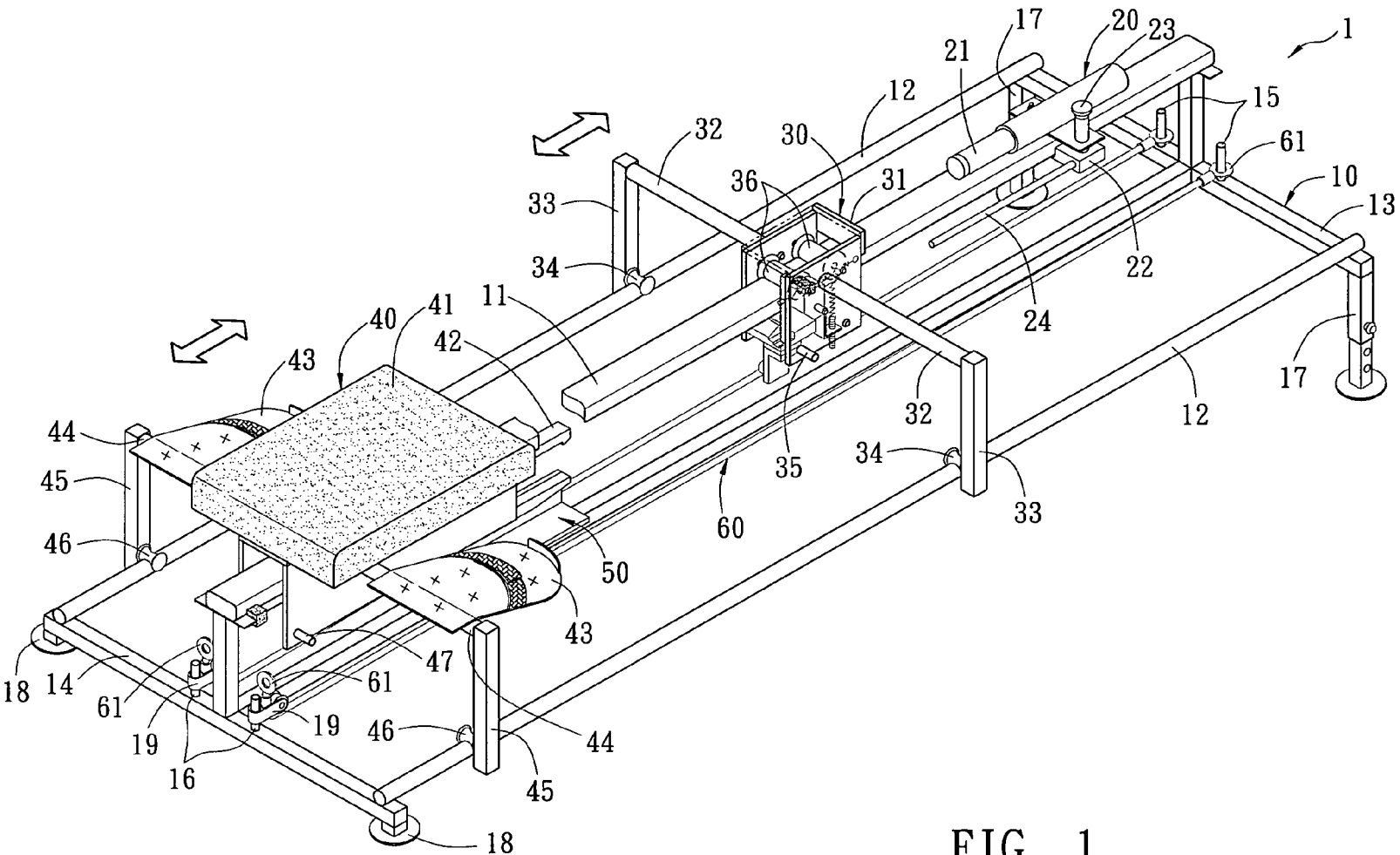
FIG. 1 is a perspective view of an embodiment according to the present invention.
Figure 2:
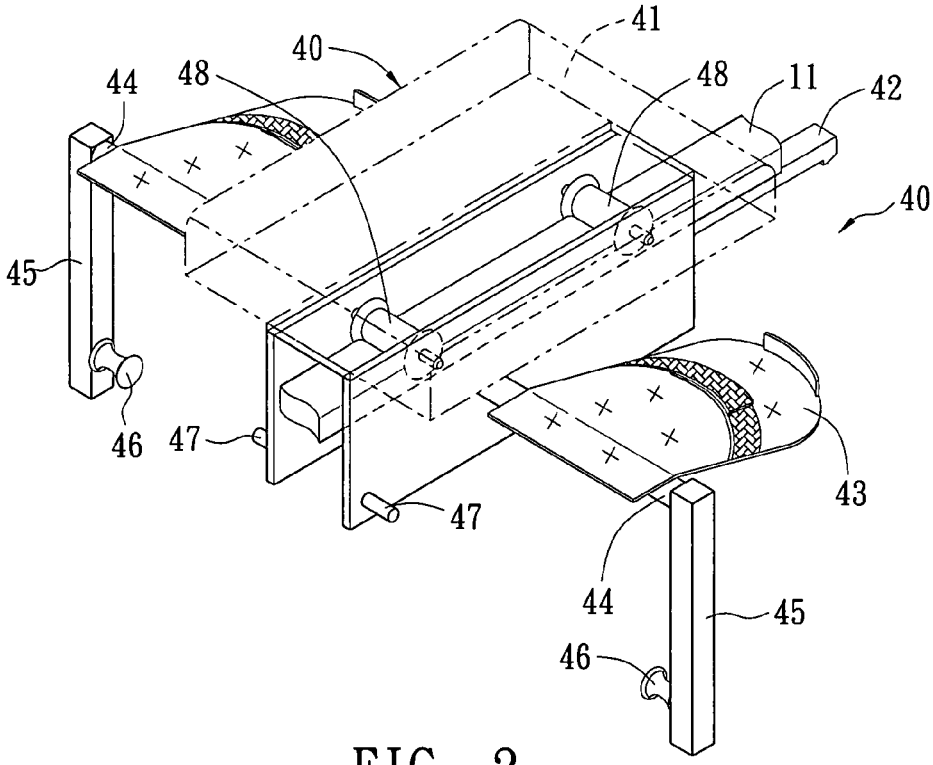
FIG. 2 is an enlarged view of an embodiment of a pedal according to the present invention.
Figure 3:
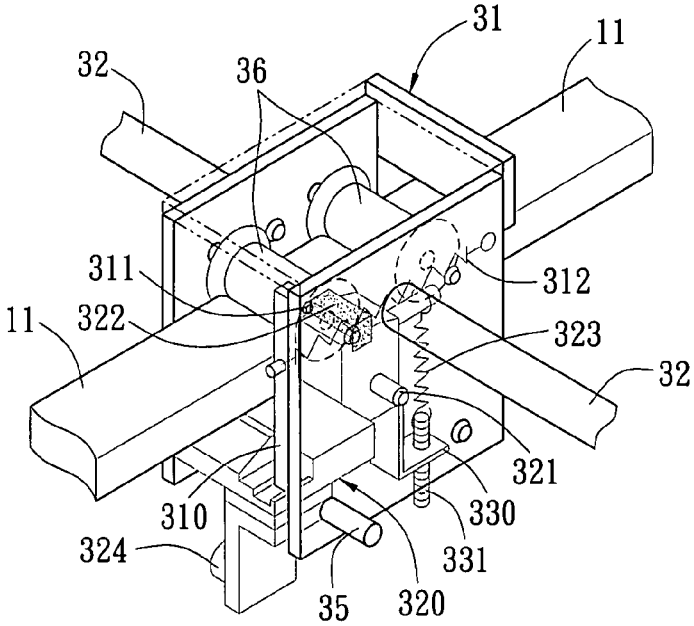
FIG. 3 is an enlarged view of an embodiment of a handle according to the present invention.

Refer from FIG. 1 to FIG. 3, a prone exerciser 1 according to the present invention includes a slide unit 10, buffering and locating member 20, a handle 30, a pedal 40 and/or at least one elastic rope 60. The slide unit 10 consists of a middle rail 11, a right-side and a left-side rails 12 respectively arranged on right side and left side of the middle rail 11. A front transverse post 13 and a rear transverse post 14 are respectively disposed on front end and rear end of the middle rail 11 and/or right-side and a left-side rails 12. Two front stand 17 and two rear stand 18 that is able to adjust height are arranged under the front transverse post 13 and the rear transverse post 14 for supporting the device standing firmly on the ground. Moreover, by adjusting height of the front stand 17 and the rear stand 18, the slide unit 10 is set to be sliding, high in front and low in rear. Furthermore, front fixing pins 15 and rear fixing pins 16 are respectively arranged on top of the middle of the front transverse post 13 and the rear transverse post 14 while two pulley sets 19 are arranged on the rear fixing pins 16. In addition, a sliding guiding slot 50 is set on bottom of the rear end of the middle rail 11, corresponding to a projecting post 324 on bottom of a rear end of a braking device 320 of the handle 30.

The buffering and locating member 20 includes a buffer bar 21 that provides buffering effects to the handle 30 when the handle 30 moves forwards against the buffer bar 21. A fixing seat 22 and a lock screw 23 are used to adjust and fix the buffering and locating member 20 on front end of the middle rail 11. A push rod 24 is installed on the fixing seat 22, facing the handle 30 so as to push away the handle 30.

The handle 30, disposed on the middle rail 11 that locates between the buffering and locating member 20 and the pedal 40, consists of a braking control member 31 for arranging the handle 30 on the middle rail 11, two grips 32 respectively set on right and left side of the braking control member 31 for holding; two rods 33 with a top end connecting to the grips 32 for supporting while a bottom end is disposed with an outer roller 34 moving in the right-side and left-side rails 12; two hooks 35 for being inserted with fixing rings 61 of the elastic rope 60; two middle rollers 36 used for supporting the handle 30 sliding forwards and backwards on the middle rail 11.

Refer to FIG. 3, the braking control member 31 includes a supporting rod 310 that is pushed by the push rod 24 and is pivoted around an axis cylinder 311; a spring 312 provides the braking control member 31 restoring force after being pivoted; a central shaft 321 used as a pivot of a braking device 320 that is restored by a spring 323. A braking block 322 is disposed on top of the braking device 320. The bottom side of the front side of the braking device 320 is connected with a L-shaped plate 330 and the braking device 320 is threaded on the braking control member 31 by a threaded bolt 331. The projecting post 324 corresponding to the guiding slot 50 on bottom of the rear end of the middle rail 11 is transversely disposed on bottom of the rear end of the braking device 320.

The handle 30 is disposed on the middle rail 11, sliding forwards and backwards between the buffering and locating member 20 and the pedal 40 and the right and left grips 32 are for holding. The braking control member 31 is to control the handle 30, braking or releasing from the middle rail 11.

The supporting rod 310 of the braking control member 31 is arranged vertically and is pivoting forwards and backwards elastically so that it can lean against the braking device 320 or away from the braking device 320 by against the push rod 24 and pivoting backwards. The braking device 320 is a suspending movable block that pivots upwards and downwards elastically by an elastic force. The braking block 322 is disposed on top of the braking device 320. When the supporting rod 310 leans against top of the rear end of the braking device 320, the braking device 320 is level and it is out of the middle rail 11 so that there is no braking action. When the supporting rod 310 pivots backwards, away from the braking device 320, the braking device 320 pivots upwards elastically by spring force so that the braking block 322 presses the middle rail 11 to have braking effects.

Refer to FIG. 2, the pedal 40 set on rear end of the middle rail 11 is composed of a cushion 41 for sitting upon, a hooked rod 42 disposed on middle of the inner side of the pedal 40 for connecting with the braking device 320 of the braking control member 31; two footrests 43 installed on a transverse rod 44 for users to place feet and inclining angle of the footrests 43 is adjustable; two transverse rods 44 connecting straight rods 45 and fixing the footrests 43; two straight rods 45 arranged between the transverse rods 44 and outer rollers 46; two hooks 47 for being inserted with fixing rings 61 of the elastic rope 60; two middle rollers 48 for supporting the pedal 40 moving forwards and backwards on the middle rail 11.

Figure 11:
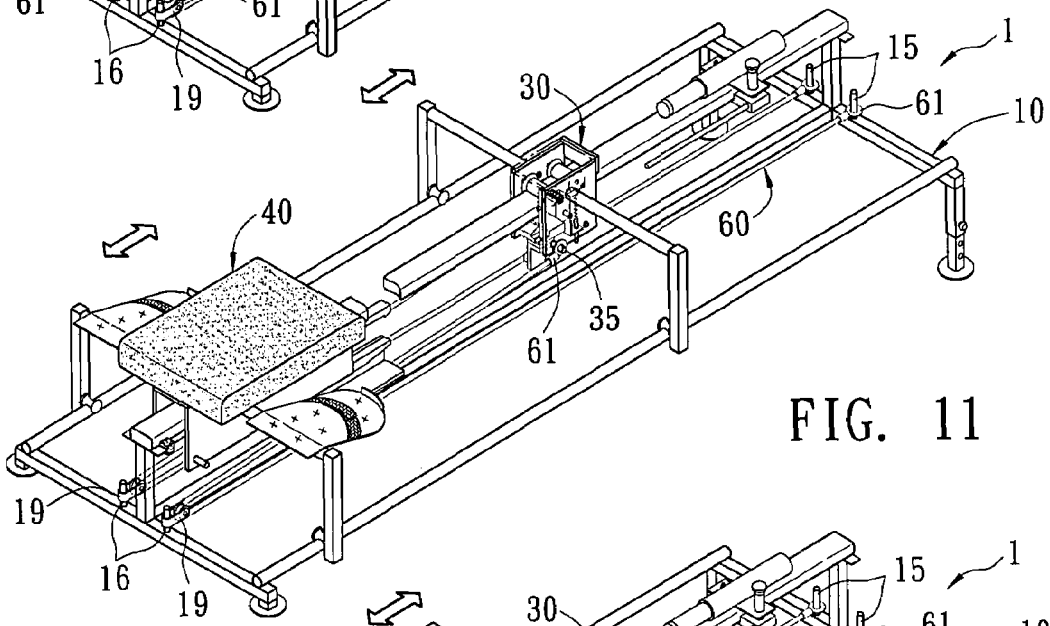
FIG. 11 is another action of an embodiment according to the present invention.
Figure 12:
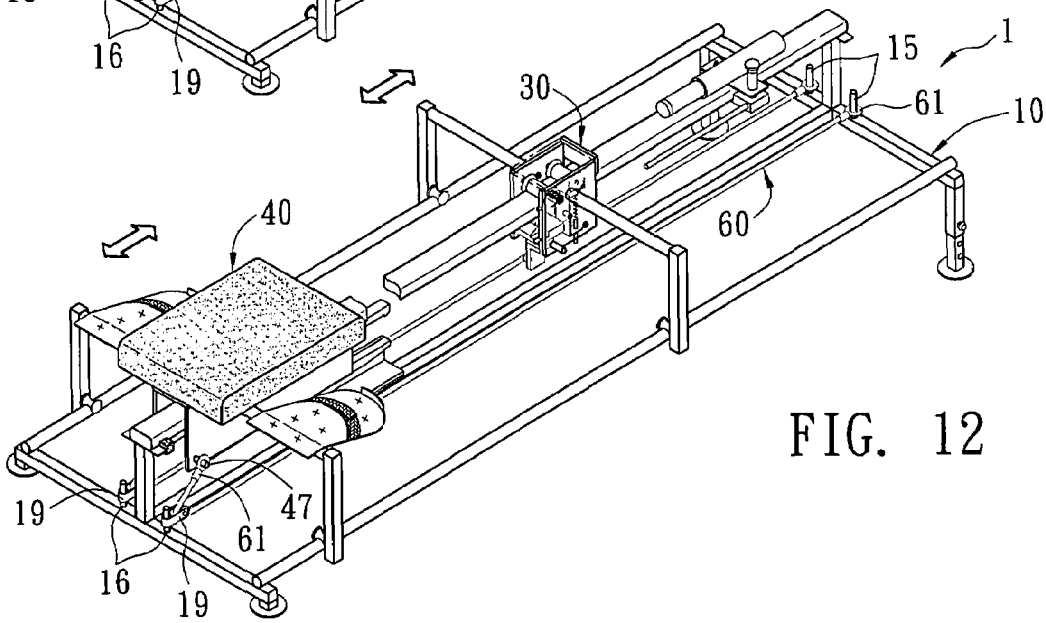
FIG. 12 is a further action of an embodiment according to the present invention.

The fixing ring 61 at one end of the elastic rope 60 is set on the front fixing pins 15 on the front transverse post 13 of the slide unit 10 while the fixing ring 61 on the other end is inserted through the pulley set 19 and then set on the rear fixing pin 16 (while the device is not used), set on the hook 35 of the handle 30, as shown in FIG. 11, or the hook 47 of the pedal 40 (as shown in FIG. 12). Thus the resistance of the handle 30 or the pedal 40 is increased while moving on the slide unit 10.

Figure 3A:
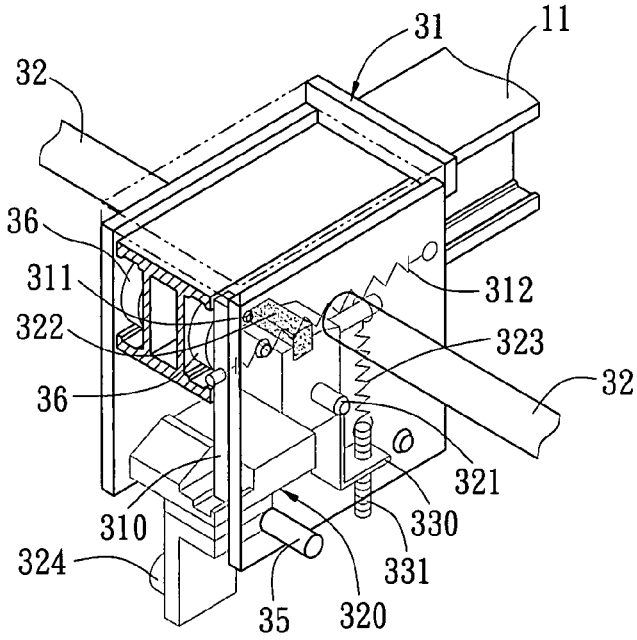
FIG. 3A is an embodiment of a middle rail according to the present invention.
Figure 3B:
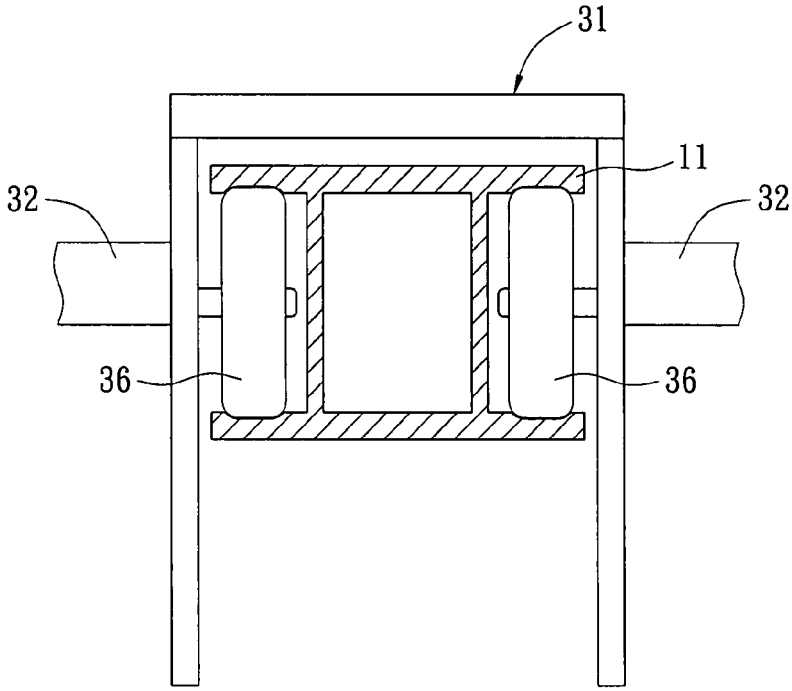
FIG. 3B is a cross sectional view of the embodiment in FIG. 3A.

The middle rail 11 is made from aluminum extrusion material and there is no restriction on cross section of the middle rail 11. It can be rectangular, as shown in FIG. 3 or II-shaped, as shown in FIG. 3A & FIG. 3B. Moreover, there is no limit on the assembling way between the middle rail 11 and the middle roller 36. Refer to FIG. 3, when the middle rail 11 is rectangular, the two middle rollers 36 are disposed on the middle rail 11 for axial sliding. When the middle rail 11 is II-shaped, as shown in FIG. 3A & FIG. 3B, the two middle rollers 36 are respectively set on inner side of C-shaped slots on right and left sides of the middle rail 11 and are moving axially so that the stability of the middle rollers are increased whiling sliding. And at the same time, the right-side and left-side rails 12, the rod 33, the outer roller 34, the straight rod 45 and the outer rollers 46 can all be removed from the device.

Figure 4:
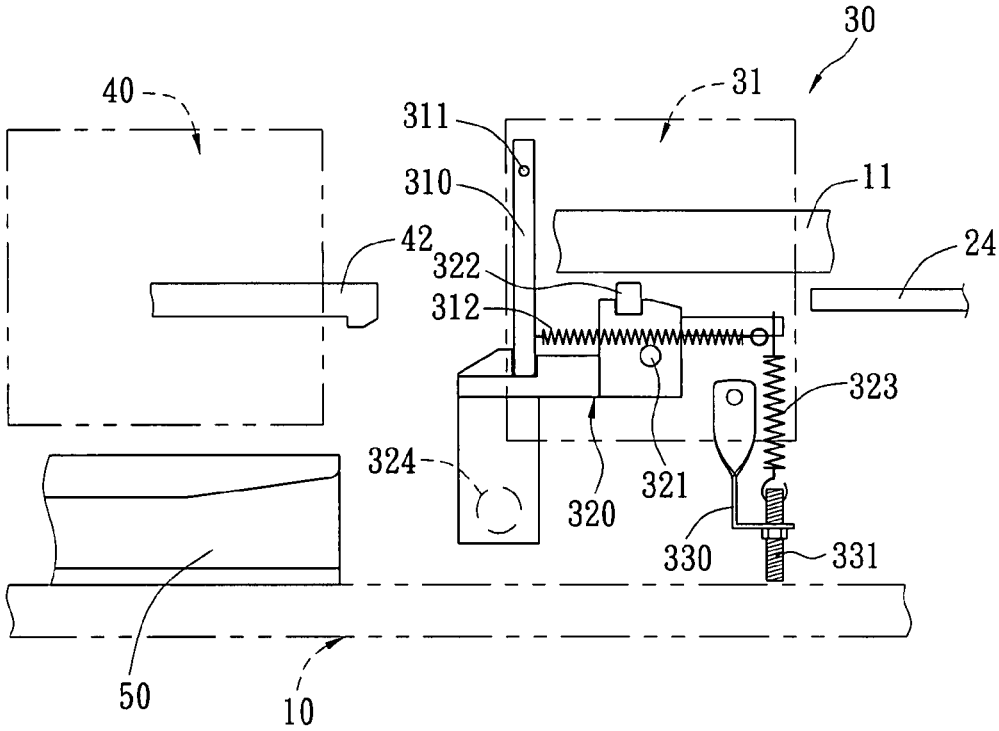
FIG. 4 is a schematic drawing showing initial action of an embodiment according to the present invention.
Figure 13:
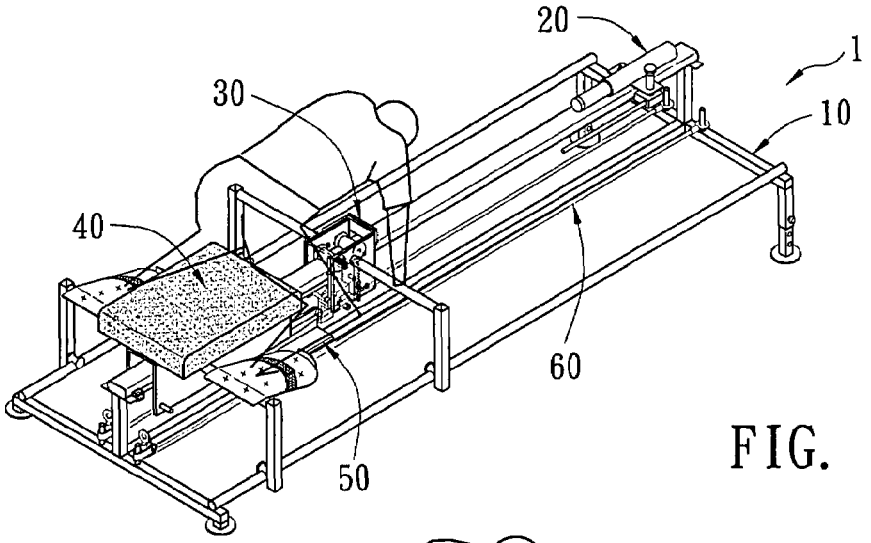
FIG. 13 is showing an operating status of an embodiment according to the present invention.

Refer to FIG. 4 & FIG. 13, now users arms as well as feet are contracted and the handle 30 is in a "stop" position. The supporting rod 310 doesn't contact with the push rod 24 and the braking block 322 of the braking device 320 doesn't contact with the middle tail 11. Thus the users prepare to push the handle 30 for moving forwards.

Figure 5:
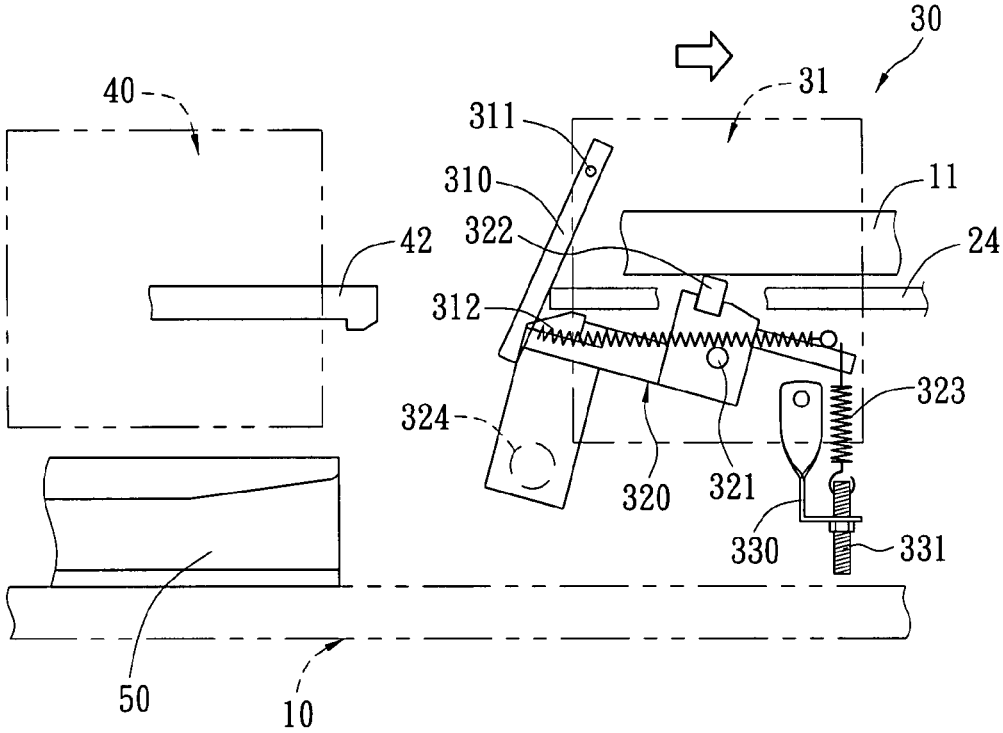
FIG. 5 is a next action of the embodiment in FIG. 4.
Figure 14:
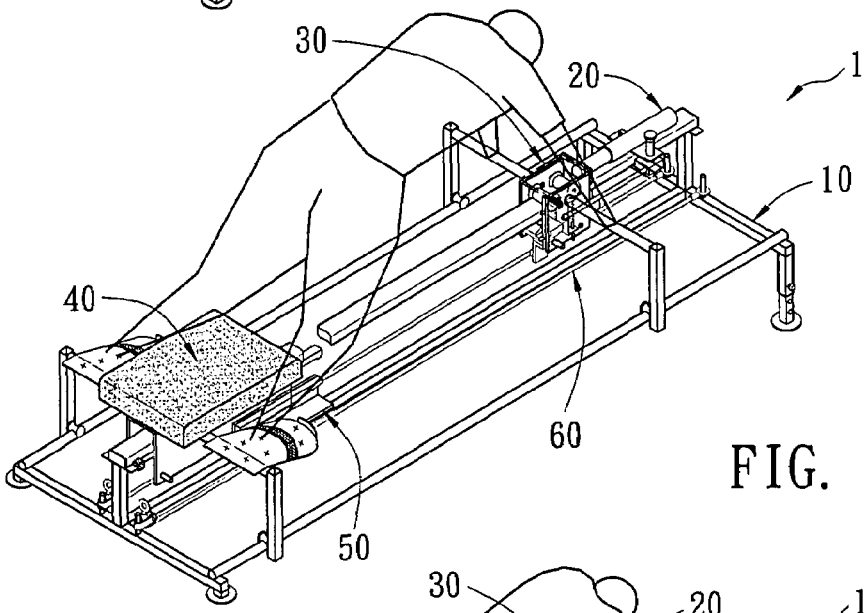
FIG. 14 is next operating status of the embodiment in FIG. 13.

Refer to FIG. 5 & FIG. 14, now the user's hands move forwards so that the body is stretched. The handle 30 moves forwards so as to make the supporting rod 310 contact with the push rod 24 and pivot around the axis cylinder 311 for separating from the braking device 320.

By tension of the spring 323, the braking device 320 pivots clockwise around the central shaft 321 so as to make the braking block 322 press the middle rail 11 tightly. Thus the handle is in braking status and is not going to move.

Figure 6:
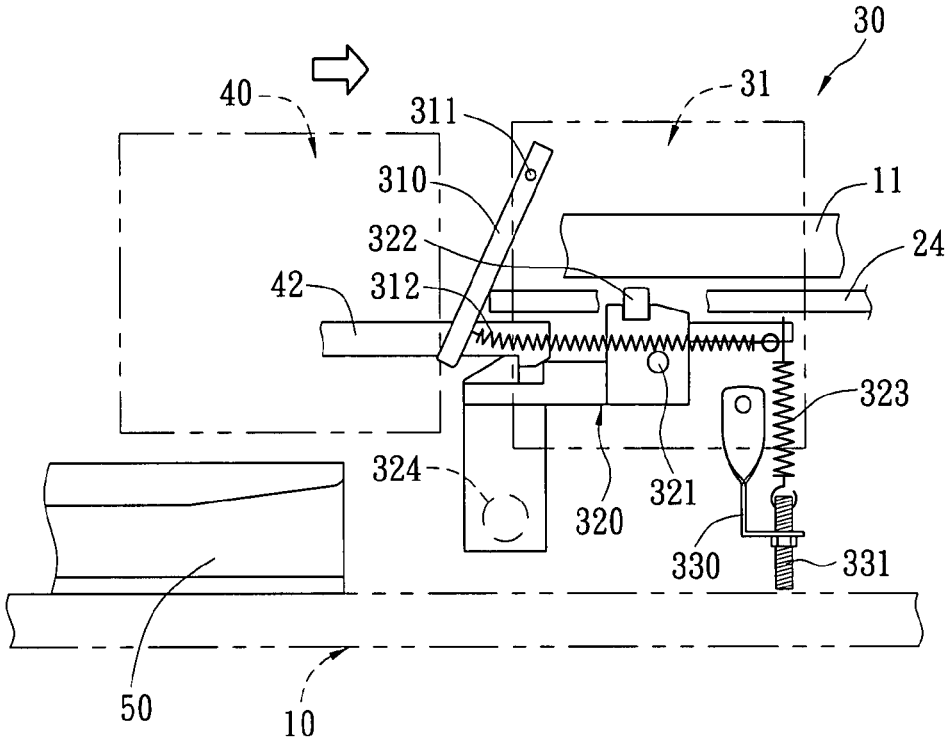
FIG. 6 is a next action of the embodiment in FIG. 5.
Figure 15:
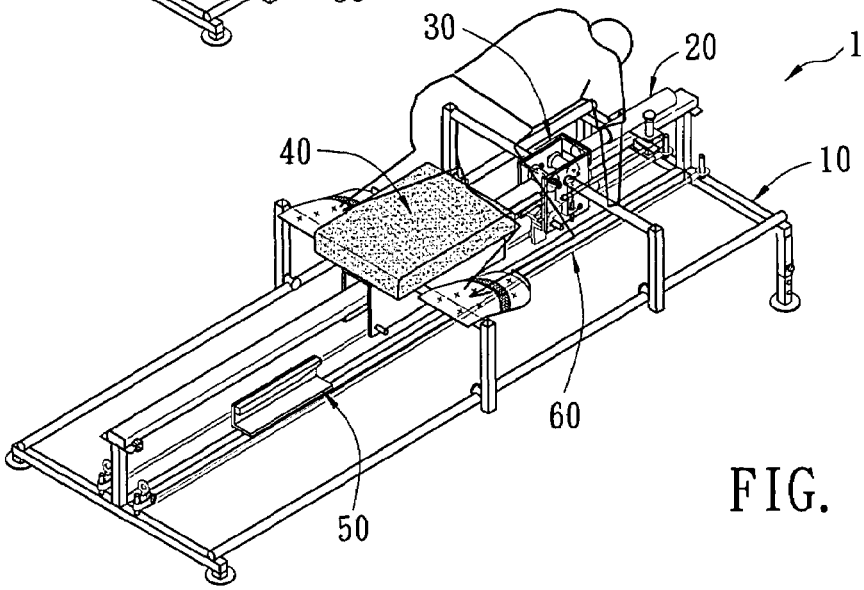
FIG. 15 is next operating status of the embodiment in FIG. 14.

Refer to FIG. 6 & FIG. 15, now user's feet move forward so that the body is contracted. The pedal 40 moves forwards and the hooked rod 42 presses the braking device 320 to move downwards so as to make the braking block 322 separate from the middle rail 11 while the hook on front end of the hooked rod 42 hooks with the braking device 320. Thus the handle 30 (the braking control member 31) fastens with the pedal 40 integratedly.

Figure 7:
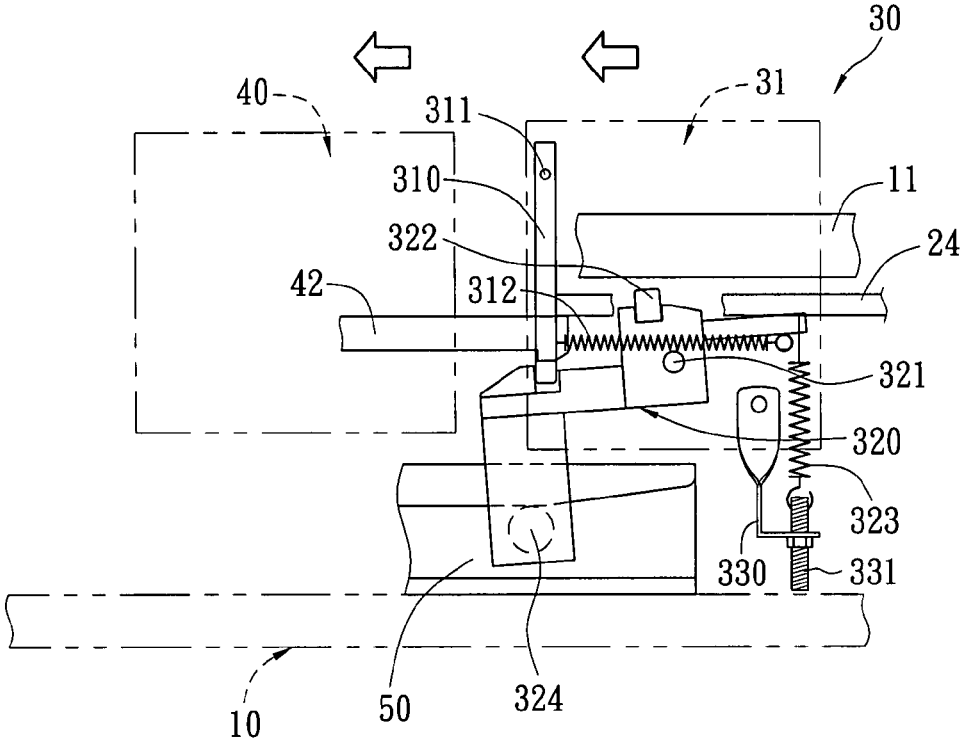
FIG. 7 is a next action of the embodiment in FIG. 6.

Refer to FIG. 7, now by the hooked rod 42 hooking with the braking control member 31, the pedal 40 and the handle 30 move backwards simultaneously with each other due to sliding status of the slide unit 10 (or the middle rail 11) as well as elastic force of the elastic rope 60, as shown in FIG. 15. When the projecting post 324 moves into the guiding slot 50, the braking device 320 pivots counterclockwise and separates from the hooked rod 42. By tension of the spring 312, the supporting rod 310 moves forwards and now the user's body is contracted and moving backwards.

Figure 8:
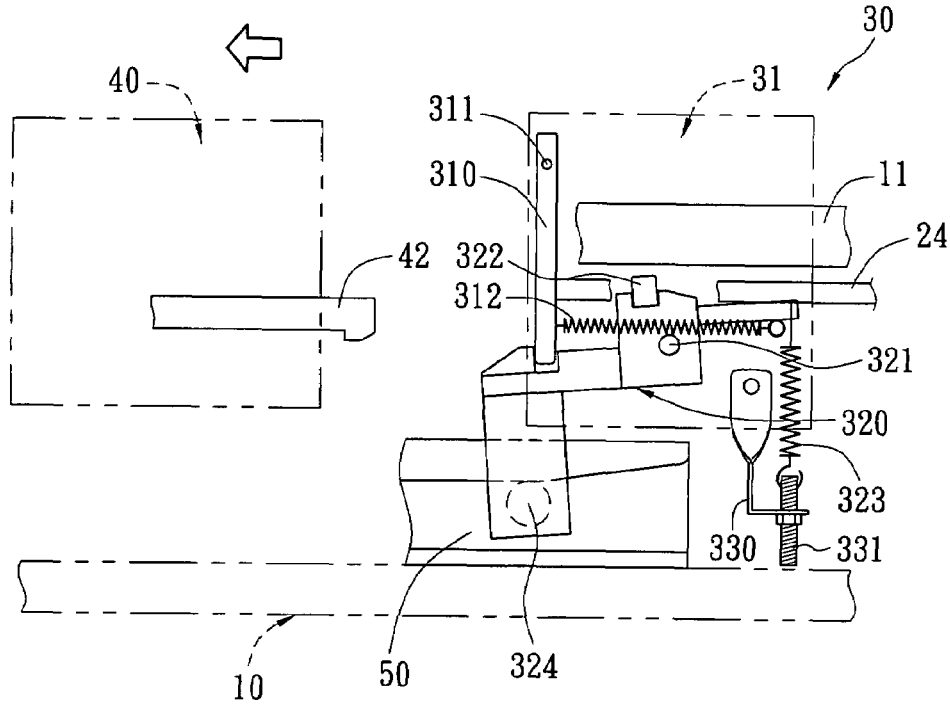
FIG. 8 is a next action of the embodiment in FIG. 7.

Refer to FIG. 8, now the pedal 40 keeps moving backwards and then separates from the handle 30.

Figure 9:
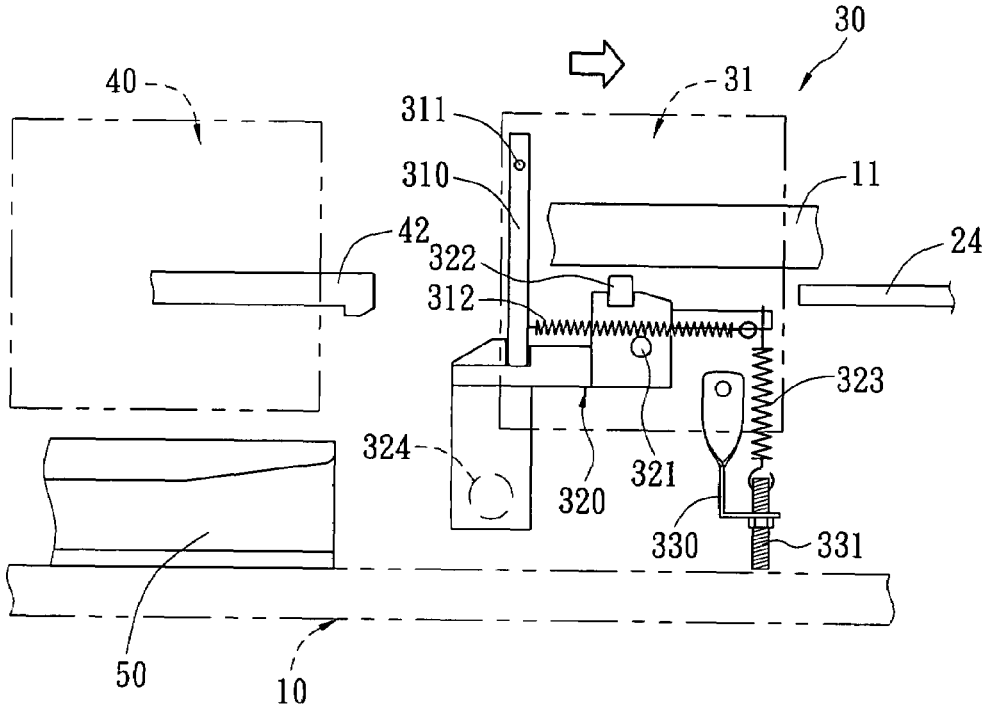
FIG. 9 is a next action of the embodiment in FIG. 8.

Refer to FIG. 9, the handle 30 moves forwards so as to make the projecting post 324 move away from the guiding slot 50, and the braking device 320 pivots clockwise around the central shaft 321 while the top part of the braking device 320 is against the supporting rod 310 so that there is a certain distance between the braking block 322 and the middle rail 11. Thus the handle 30 can move freely on the middle rail 11 or turn back to a standby status as shown in FIG. 4 & FIG. 13. Therefore, there is a cycle for movement from FIG. 4 to FIG. 9.

Figure 10:
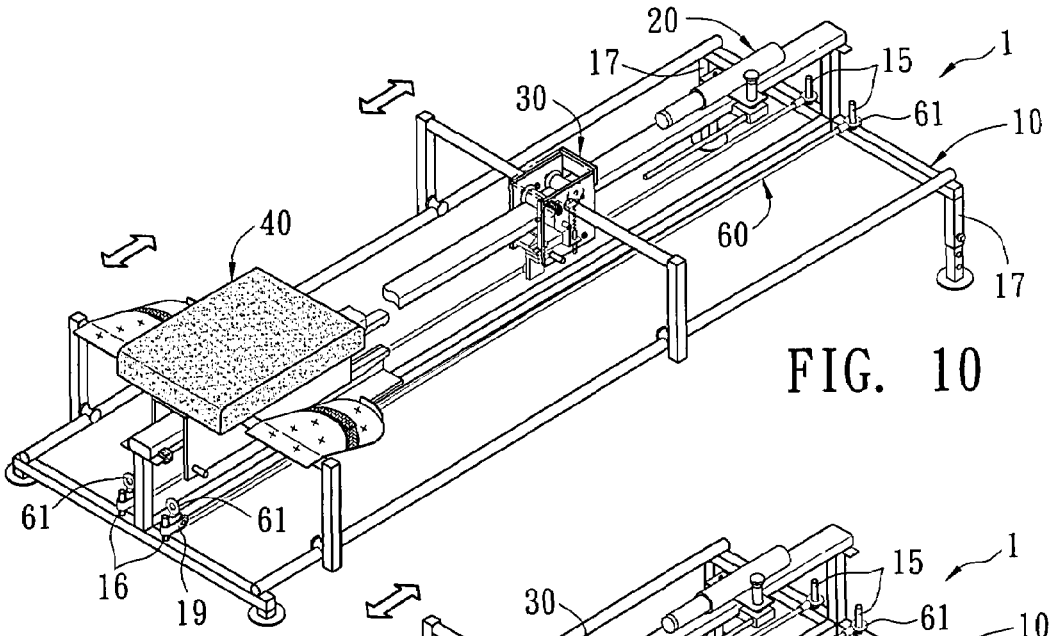
FIG. 10 is a schematic drawing showing an action of an embodiment according to the present invention.

Refer to FIG. 10, height of the front stand 17 can be adjusted for changing slope of the slide unit 10 so as to adjust or increase resistance of the handle 30 and the pedal 40 while moving forwards. The elastic rope 60 is not necessary now.

Refer to FIG. 11, the fixing ring 61 at one end of the two right-and-left elastic ropes 60 is set on the front fixing pin 15 of the slide unit 10 while the other end thereof is inserted through the pulley set 19 and then set on the hook 35 of the handle 30 so as to increase resistance of the handle 30. Thus when users are stretching/contracting, upper part of the body can have higher loading of stretching force/contracting force.

Refer to FIG. 12, the fixing ring 61 at one end of the two right-and-left elastic ropes 60 is set on the front fixing pin 15 of the slide unit 10 while the other end thereof is inserted, through the pulley set 19 and then set on the hook 47 of the pedal 40 so as to increase resistance of the pedal 40. Thus when users are stretching/contracting, lower part of the body can have higher loading of stretching force/contracting force.

Figure 16:
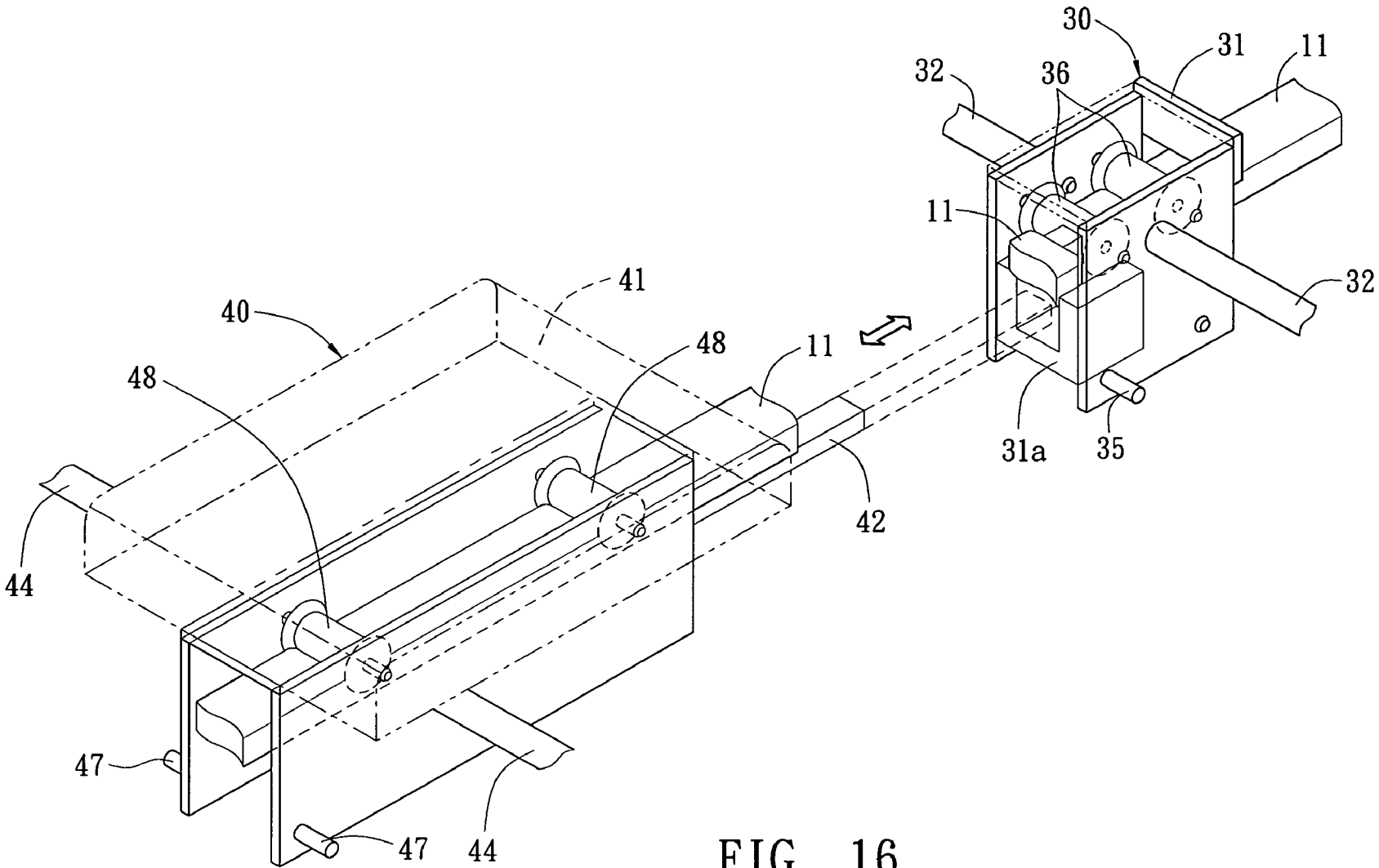
FIG. 16 is an embodiment of the handle according to the present invention.

Refer to FIG. 16, a prone exerciser 1 according to the present invention consists of the braking control member 31 which may utilize a electromagnetic mechanism 31*a* to provide the electromagnetic function for the braking control member 31 to brake and lock the middle rail 11. The handle 30, which also may utilize a electromagnetic mechanism 31*a* to combine with the pedal 40 and the hooked rod 42, that makes both the middle rail 11 of the handle 30 and the pedal 40 be able to brake, connect, and separate. Further, the additional components including the supporting rod 310, the braking device 320, the push rod 24, and the braking block 322 are not necessary and can be replace by electromagnetic mechanism 31*a*. The design of electromagnetic mechanism can be achieved by related electronic magnetic techniques available now so the details are not mentioned here.

As mentioned above, the prone exerciser 1 according to the present invention achieves a cycle of exercise a shown from FIG. 13 to FIG. 15 that is unable to do by prior arts.

While a preferred embodiment of the invention has been shown and described in detail, it will be readily understood and appreciated that numerous omissions, changes and additions may be made without departing from the spirit and scope of the invention.

What is claimed is:

1. A prone exerciser comprising a slide unit, a buffering and locating member, a handle, and a pedal, wherein the slide unit having at least a rail for accommodating the handle and the pedal sliding forwards and backwards thereof, a set of stands arranged on front end of the slide for supporting the prone exerciser and adjusting the slide unit into a high in front and low in rear status, and a sliding guiding slot set on bottom of the rear end of the rail and corresponding to a projecting post on bottom of a rear end of a braking device of the handle;

the buffering and locating member fixed on front end of the rail comprising a buffer bar that provides buffering effects to the handle when the handle moves forwards and facing towards the handle; and a push rod facing the handle for pushing a away a supporting rod on a braking control member of the handle;

the handle is disposed on the rail and is sliding between the buffering and locating member and the pedal; the handle comprising two grips for holding and a braking control member for control of braking or releasing action between the handle and the rail;

the braking control member having a supporting rod arranged vertically and pivoted forwards and backwards elastically so that the supporting rod leans against a braking device or moves backwards, away from the braking device by contacting with the push rod of the buffering and locating member; the braking device is a suspending movable block that pivots upwards and downwards elastically by an elastic force while a braking block is disposed on top of the braking device; when the supporting rod leans against the rear end of the braking device, the braking device is level and is out of the rail so that there is no braking action and when the supporting rod pivots backwards, away from the braking device, the braking device pivots upwards elastically by spring force so that the braking block presses the rail firmly to have braking effects; a projecting post is disposed on bottom of the rear end of the braking device;

the pedal that is set on the rail and slides forwards and backwards between the handle and read end of the rail comprising a cushion for sitting upon, two footrests respectively installed on left rear right sides of the cushion and a hooked rod for connecting with the braking device of the braking control member;

while exercising, the handle moves forwards so that the supporting rod of the braking control member contacts with the push rod of the buffering and locating member and then pivots backwards to separate from the braking device; thus the braking device pivots upwards so as to make the braking block press the rail tightly and the handle is in braking status on the rail; the pedal is moved forwards closely to the handle and the hooked rod of the pedal presses the braking device to pivot downwards so as to make the braking block separate from the rail while the hook on front end of the hooked rod hooks with the braking device so that the handle fastens with the pedal integratedly; the pedal and the handle move backwards simultaneously with each other due to sliding status of the slide unit and the projecting post of the braking device also moves backwards into the guiding slot so that the braking device pivots downwards and separates from the hooked rod; the pedal keeps moving backwards and then separates from the handle; the handle moves forwards so as to make the projecting post of the braking device move away from the guiding slot and the braking device pivots upwards, back to original place while the supporting rod pivots forwards, hack to original place and leans against the braking device so that the prone exerciser turns back to original status and a cycle for movement is finished.

2. The device as claimed in claim 1, wherein the rail is a straight tube with rectangular cross section so that the handle is disposed on the rail by rollers for sliding forwards and backwards.

3. The device as claimed in claim 1, wherein the rail is a straight tube with II-shaped cross section so that the handle is set on the rail by two rollers respectively arranged inside C-shaped slots on right and left sides of the rail for sliding forwards and backwards.

4. The device as claimed in claim 1, wherein the exerciser further comprising at least one elastic rope with one end set on front end of the slide unit while the other end thereof is inserted through rear end of the slide unit and then set on the handle or the pedal so as to increase resistance of the handle or the pedal while sliding forwards and backwards on the rail.

5. The device as claimed in claim 1, wherein at least one hook is disposed on the handle or the pedal for being set with the elastic rope.

6. The device as claimed in claim 1, wherein the footrest of the pedal inclines forwards at a certain angle.

7. The device as claimed in claim 1, wherein inclining angle of the footrest of the pedal is adjustable.

8. The device as claimed in claim 1, wherein a front stand of the slide unit of the pedal is adjustable into different height.

* * * * *